US011782353B2

(12) United States Patent
Nakamura et al.

(10) Patent No.: US 11,782,353 B2
(45) Date of Patent: Oct. 10, 2023

(54) METHOD FOR PRODUCING ELECTROPHOTOGRAPHIC PHOTOSENSITIVE MEMBER

(71) Applicant: CANON KABUSHIKI KAISHA, Tokyo (JP)

(72) Inventors: Nobuhiro Nakamura, Shizuoka (JP); Tomohito Ishida, Shizuoka (JP); Shuhei Iwasaki, Kanagawa (JP); Hiroyuki Watanabe, Shizuoka (JP); Tatsuya Yamaai, Kanagawa (JP); Yuka Ishiduka, Shizuoka (JP); Yota Ito, Tokyo (JP); Takeshi Murakami, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 171 days.

(21) Appl. No.: 17/229,475

(22) Filed: Apr. 13, 2021

(65) Prior Publication Data

US 2021/0325793 A1 Oct. 21, 2021

(30) Foreign Application Priority Data

Apr. 21, 2020 (JP) ..... 2020-075637

(51) Int. Cl.
*G03G 5/047* (2006.01)
*G03G 5/147* (2006.01)

(52) U.S. Cl.
CPC ..... *G03G 5/047* (2013.01); *G03G 5/147* (2013.01)

(58) Field of Classification Search
CPC ..... G03G 5/047; G03G 5/147
See application file for complete search history.

(56) References Cited

U.S. PATENT DOCUMENTS 4,908,329 A 3/1990 Kanai et al.
4,908,330 A 3/1990 Arai et al.
(Continued)

FOREIGN PATENT DOCUMENTS

JP H02-150850 A 6/1990
JP 2013011753 A * 1/2013
(Continued)

OTHER PUBLICATIONS

English machine translation of the description of JP-2013011753-A (Year: 2013).*
(Continued)

*Primary Examiner* — Peter L Vajda
*Assistant Examiner* — Boone Alexander Evans
(74) *Attorney, Agent, or Firm* — VENABLE LLP

(57) ABSTRACT

A method for producing an electrophotographic photosensitive member including: forming a photosensitive layer; and forming a protective layer, wherein the step of forming the photosensitive layer forms a photosensitive layer having an amount of residual solvent of a first solvent in the photosensitive layer of 0.05% to 2.50% and an amount of residual solvent of a second solvent in the photosensitive layer of 0.50% to 2.50%, and the step of forming the protective layer includes step (A) of forming a cured film and step (B) of forming the protective layer having wrinkle shapes, wherein, in step (A), the irradiated coating film is heated at a heating temperature lower than a boiling point of the first solvent and in step (B), the cured film is heated at a heating temperature higher than a boiling point of the first solvent.

8 Claims, 3 Drawing Sheets

(56) References Cited

U.S. PATENT DOCUMENTS

| | | | |
|---|---|---|---|
| 5,759,291 | A | 6/1998 | Ichinose et al. |
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 8,481,236 | B2 | 7/2013 | Tanaka et al. |
| 8,841,052 | B2 | 9/2014 | Watariguchi et al. |
| 8,865,381 | B2 | 10/2014 | Tanaka et al. |
| 8,974,991 | B2 | 3/2015 | Kawahara et al. |
| 9,029,054 | B2 | 5/2015 | Okuda et al. |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,068,083 | B2 | 6/2015 | Tanaka et al. |
| 9,069,267 | B2 | 6/2015 | Kaku et al. |
| 9,256,145 | B2 | 2/2016 | Fujii et al. |
| 9,280,071 | B2 | 3/2016 | Maruyama et al. |
| 9,304,416 | B2 | 4/2016 | Noguchi et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,405,206 | B2 | 8/2016 | Kawaguchi et al. |
| 9,436,107 | B2 | 9/2016 | Murakami et al. |
| 9,459,542 | B2 | 10/2016 | Tanaka et al. |
| 9,523,929 | B2 | 12/2016 | Nakamura et al. |
| 9,535,346 | B2 | 1/2017 | Sekiya et al. |
| 9,535,347 | B2 | 1/2017 | Watariguchi et al. |
| 9,599,915 | B2 | 3/2017 | Anezaki et al. |
| 9,599,917 | B2 | 3/2017 | Okuda et al. |
| 9,658,543 | B2 | 5/2017 | Murakami et al. |
| 9,684,277 | B2 | 6/2017 | Yamamoto et al. |
| 9,726,992 | B2 | 8/2017 | Sakuma et al. |
| 9,772,569 | B2 | 9/2017 | Tanaka et al. |
| 9,851,646 | B2 | 12/2017 | Tomono et al. |
| 10,018,928 | B2 | 7/2018 | Murakami et al. |
| 10,073,362 | B2 | 9/2018 | Fujii et al. |
| 10,095,137 | B2 | 10/2018 | Murakami et al. |
| 10,372,050 | B2 | 8/2019 | Nishi et al. |
| 10,416,581 | B2 | 9/2019 | Ito et al. |
| 10,452,021 | B2 | 10/2019 | Miura et al. |
| 10,539,892 | B2 | 1/2020 | Nishida et al. |
| 10,545,453 | B2 | 1/2020 | Iwasaki et al. |
| 10,558,132 | B2 | 2/2020 | Ishiduka et al. |
| 10,558,133 | B2 | 2/2020 | Nakamura et al. |
| 10,642,177 | B2 | 5/2020 | Nakamura et al. |
| 10,663,913 | B2 | 5/2020 | Yamaai et al. |
| 10,691,033 | B2 | 6/2020 | Nishida et al. |
| 10,747,130 | B2 | 8/2020 | Okuda et al. |
| 10,747,131 | B2 | 8/2020 | Watanabe et al. |
| 10,831,117 | B2 | 11/2020 | Sakakibara et al. |
| 10,831,118 | B2 | 11/2020 | Watanabe et al. |
| 10,838,315 | B2 | 11/2020 | Shimozawa et al. |
| 10,942,462 | B2 | 3/2021 | Ito et al. |
| 11,003,102 | B2 | 5/2021 | Ishiduka et al. |
| 2014/0004450 | A1 | 1/2014 | Tokimitsu et al. |
| 2015/0185630 | A1 | 7/2015 | Ito et al. |
| 2015/0185634 | A1 | 7/2015 | Sekiya et al. |
| 2017/0060008 | A1 | 3/2017 | Okuda et al. |
| 2017/0075236 | A1* | 3/2017 | Kurachi ..... G03G 5/06142 |
| 2018/0246425 | A1* | 8/2018 | Kuno ..... G03G 5/04 |
| 2020/0264526 | A1 | 8/2020 | Shimozawa et al. |
| 2020/0393771 | A1 | 12/2020 | Iwasaki et al. |
| 2020/0409278 | A1 | 12/2020 | Makisumi et al. |
| 2020/0409279 | A1 | 12/2020 | Sekiya et al. |
| 2020/0409280 | A1 | 12/2020 | Ishida et al. |
| 2020/0409281 | A1 | 12/2020 | Watariguchi et al. |
| 2021/0026260 | A1 | 1/2021 | Noguchi et al. |
| 2021/0026268 | A1 | 1/2021 | Murakami et al. |
| 2021/0116826 | A1 | 4/2021 | Nishida et al. |
| 2021/0116833 | A1 | 4/2021 | Ishiduka et al. |

FOREIGN PATENT DOCUMENTS

| | | | |
|---|---|---|---|
| JP | 2014-178425 A | 9/2014 | |
| JP | 5751055 B2 * | 7/2015 | ..... B29C 59/16 |

OTHER PUBLICATIONS

English machine translation of the description of JP-5751055-B2 (Year: 2015).*

U.S. Appl. No. 17/228,879, Tomohito Ishida, filed Apr. 13, 2021.

U.S. Appl. No. 17/230,550, Shuhei Iwasaki, filed Apr. 14, 2021.

* cited by examiner

METHOD FOR PRODUCING ELECTROPHOTOGRAPHIC PHOTOSENSITIVE MEMBER

BACKGROUND OF THE INVENTION

Field of the Invention

The present invention relates to a method for producing an electrophotographic photosensitive member.

Description of the Related Art

As electrophotographic photosensitive members mounted on process cartridges and electrophotographic apparatuses, electrophotographic photosensitive members containing organic photoconductive substances (charge generation substances) have been used. In recent years, the electrophotographic apparatus having a longer life has been required, and therefore, it is desired to provide an electrophotographic photosensitive member capable of improving image quality and abrasion resistance (mechanical durability) and suppressing potential fluctuation.

As a method for improving the abrasion resistance of the electrophotographic photosensitive member (hereinafter, also simply referred to as "photosensitive member"), a technique has been proposed for using a radically polymerizable resin on a surface of the photosensitive member and providing the photosensitive member with a cured layer as a surface layer thereof to thereby enhance the mechanical strength of the surface layer.

The electrophotographic photosensitive member is generally used in an electrophotographic image forming process comprising a charging step, an exposure step, a developing step, a transfer step and a cleaning step. Among them, the cleaning step of removing residual toner on the electrophotographic photosensitive member after the transfer step is an important step in order to obtain a clear image. As this cleaning method, a method for pressing a rubber-like cleaning blade against the electrophotographic photosensitive member to scrape off the toner, is commonly used.

However, with the above cleaning method, the frictional force between the cleaning blade and the electrophotographic photosensitive member is large, and therefore the cleaning blade is prone to chattering and stripping. Furthermore, poor cleaning due to grooves or chipping of an edge of the cleaning blade facilitates to occur. Here, chattering of the cleaning blade is a phenomenon caused by vibration of the cleaning blade due to an increase in frictional resistance between the cleaning blade and the peripheral surface of the electrophotographic photosensitive member. Moreover, the stripping is a phenomenon in which the cleaning blade is inverted in a moving direction of the electrophotographic photosensitive member.

The problem of the cleaning blade becomes more remarkable as a mechanical strength of the surface layer of the electrophotographic photosensitive member is higher. i.e., as the peripheral surface of the electrophotographic photosensitive member is less likely to be abrased. Namely, this problem occurs due to that the surface layer of the electrophotographic photosensitive member is cured to form a cured layer as described above, which enhances the mechanical strength of the surface layer. Moreover, a surface layer of an organic electrophotographic photosensitive member is generally formed by a dip coating method, but the surface of the surface layer (i.e., the peripheral surface of the electrophotographic photosensitive member) formed by the dip coating method is quite smooth. Therefore, the contact area between the cleaning blade and the peripheral surface of the electrophotographic photosensitive member becomes large, and the frictional resistance between the cleaning blade, and the peripheral surface of the electrophotographic photosensitive member is increased, which renders the above problem remarkable.

As a method for overcoming the aforementioned problems, a method for reducing a contact area between a surface of a photosensitive member and a cleaning blade by appropriately roughening a surface of the photosensitive member to reduce frictional force, has been proposed.

Japanese Patent Application Laid-Open No. H02-150850 disclosed a technique for polishing a surface of a photosensitive member with an abrasive film. Moreover, Japanese Patent Application Laid-Open No. 2014-178425 discloses a technique for containing fine particulate metal oxide in the surface layer.

In Japanese Patent Application Laid-Open No. H02-150850, the surface is roughened by polishing with an abrasive film by using a film winding apparatus. However, the abrasive film is a consumable item and high in cost. Moreover, a non-uniform shape of the photosensitive member may be formed due to non-uniformity of the abrasive film itself. Furthermore, shaved powder of the photosensitive layer due to mechanical fracture thereof and abrasive materials derived from the film may cause problems, and it is necessary to adjust the apparatus and set polishing conditions so that such problems do not occur. Such mechanical processing is complicated because the processing basically needs countermeasure against problems, such as special capital investment, cost increase due to consumables, processing non-uniformity and mechanical fracture. In Japanese Patent Application Laid-Open No. 2014-178425, a concave-convex shape is imparted by adding fine particulate metal oxide to the surface layer. However, in order to prepare a coating solution containing such a fine particle, a step of applying mechanical force to the fine particle to disperse the particle in the coating solution is usually required. Moreover, irregularity of concave-convex may occur due to variation in dispersion of the fine particle and due to variation in particle size by particle aggregation. Further, the characteristics of the photosensitive member may be adversely affected depending on an amount added, whereby a degree of freedom of the amount is not quite large.

Namely, in the surface roughening method of the prior art, man-hours are required, the cost is high, and a portion having a non-uniform shape may be formed, and therefore a surface roughening method for uniformly imparting a finely controlled shape by a simpler method, has been required.

Thus, an object of the present invention is to provide a method for roughening a surface of a photosensitive member to uniformly impart a finely controlled shape by a simpler method.

SUMMARY OF THE INVENTION

The aforementioned object can be achieved by the present invention below. Namely, the method for producing an electrophotographic photosensitive member according to the present invention is a method for producing an electrophotographic photosensitive member comprising a support, a photosensitive layer, and a protective layer having an outer surface with wrinkles in this order, the method comprising the following steps: (i) forming the photosensitive layer on the support, and (ii) forming the protective layer on the photosensitive layer, wherein the step (i) is a step of forming a coating film for the photosensitive layer by applying a coating solution for the photosensitive layer comprising a first solvent, a second solvent having a boiling point higher than that of the first solvent, a charge transport substance and a resin, and then heating the coating film for the photosensitive layer to form the photosensitive layer, wherein an amount of residual solvent of the first solvent in the photosensitive layer is 0.05% to 2.50% by mass based on the total mass of the photosensitive layer and an amount of residual solvent of the second solvent in the photosensitive layer is 0.50% to 2.50% by mass based on the total mass of the photosensitive layer, and the step (ii) comprises the following steps: (A) forming a coating film for the protective layer by applying a coating solution for the protective layer comprising a compound having a chain polymerizable functional group, irradiating the coating film for the protective layer with radiation, followed by heating to form a cured film with a film thickness of 1.5 μm or less, and (B) further heating the cured film to form the protective layer, wherein a heating temperature in the step (A) is lower than a boiling point of the first solvent, and a heating temperature in the step (B) is higher than a boiling point of the first solvent.

According to the present invention, a method for roughening an outer surface of a photosensitive member to uniformly impart finely controlled wrinkles by a simpler method, can be provided. Further, according to the present invention, a method for producing a photosensitive member to reduce abrasion force with a cleaning blade, can be provided.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present invention relates to a method for producing an electrophotographic photosensitive member having a support, a photosensitive layer, and a protective layer having an outer surface with wrinkles in this order, comprising: (i) forming the protective layer on the support, and (ii) forming the protective layer on the photosensitive layer.

Relationship between the production method of the present invention and the shape of wrinkles on the outer surface of the protective layer obtained by the present invention (hereinafter, also referred to as "wrinkle shape") will be described.

The phenomenon that when forming the protective layer, which is a cured film, in step (ii), the surface of the protective layer changes into a wrinkle shape, is generally recognized as a coating film defect.

However, the present inventors have found, as a result of diligent experimentation, a method for controlling occurrence of changes in wrinkle shape in a simple manner and rendering the wrinkle shape fine and uniform. Namely, the present inventors have found a simple method for producing a photosensitive member having a wrinkle shape and reducing frictional resistance (hereinafter, also referred to as "torque") between a peripheral surface of an electrophotographic photosensitive member and a cleaning blade when used in an electrophotographic apparatus.

Figure 1:
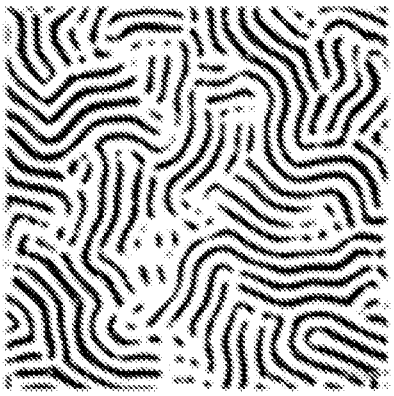
FIG. 1 is a schematic view of wrinkles when a surface of an electrophotographic photosensitive member is viewed from above.

The wrinkle shape formed on the outer surface of the protective layer (the outer surface of the photosensitive member) by the production method of the present invention has a convex-concave shape in stripe form (the black portion is a concave portion, and the white portion is a convex portion.) that can be observed when the surface of the photosensitive member is viewed from above as shown in FIG. 1. The stripe shape is not unidirectional and has random shapes, such as a curved shape, a broken shape, and a branched shape, which however exhibits isotropy. According to the present invention, this wrinkle shape is finely and uniformly formed.

A mechanism for generating the wrinkle shape is considered that when a cured film is formed on the photosensitive layer in step (A) in step (ii) and then the cured film is further heated in step (B), there occurs a difference in amounts of deformation between the cured film and the photosensitive layer, which results in generation of compressive stress applied in a surface direction to cause buckling, to generate the wrinkle shape on the surface of the cured film.

The reason why this wrinkle shape can be finely and uniformly formed is considered as follows.

When carrying out heating in step (B) in step (ii) of forming the protective layer according to the production method of the present invention, a first solvent and a second solvent having different boiling points are each homogeneously distributed and present in the photosensitive layer. At this time, by heating at a temperature higher than a boiling point of the first solvent, the first solvent evaporates more rapidly than the second solvent, so that the portion is apt to be a starting point of buckling due to compressive stress, and these starting points are formed in uniform manner over the entire surface. Thereafter, the wrinkle shape is considered to be formed finely and uniformly by gradually evaporating the second solvent. Moreover, the heating temperature in step (A) is lower than the boiling point of the first solvent, so that rapid solvent evaporation is suppressed. Therefore, the cured film can be formed while maintaining an appropriate amount of residual solvent in the photosensitive layer. As a result, appropriate deformation of the photosensitive layer and the cured film in step (B) described above is secured, and a fine and uniform wrinkle shape can be formed.

The coating solution for a photosensitive layer of the present invention contains a first solvent, a second solvent having a boiling point higher than that of the first solvent, a charge transport substance, and a resin.

The photosensitive layer is formed by applying this coating solution for the photosensitive layer to form a coating film for the photosensitive layer, heating and drying the film.

In this case, when forming the protective layer in step (ii) in order to form a protective layer having a fine and uniform wrinkle shape on the surface, the amount of residual solvent in the photosensitive layer after step (i) needs to be specified. The amount of residual solvent of the first solvent in the photosensitive layer needs to be 0.05% to 2.50% by mass. If the amount is less than 0.05% by mass, the number of the starting points of buckling is reduced and a uniform wrinkle shape is hardly formed. If the amount exceeds 2.50% by mass, the buckling may become large and the wrinkle shape may become large, or the uniformity of wrinkle shape may be decreased. The amount of residual solvent of the second solvent in the photosensitive layer needs to be 0.50% to 2.50% by mass. If the amount is less than 0.50% by mass, a fine wrinkle shape is hardly formed. If the amount exceeds 2.50% by mass, the buckling may become large and the wrinkle shape may become large, or the uniformity may be decreased.

Moreover, the ratio of the amount of residual solvent of the second solvent to the amount of residual solvent of the first solvent is preferably 1.00 to 15.00. Within this range, the balance between the first solvent and the second solvent is favorable, the starting points of buckling due to evaporation of the first solvent are introduced in fine and uniform manner over the entire surface, and the wrinkle shape is facilitated to be finer and more uniform.

A method for adjusting the amount of residual solvent can be appropriately adjusted depending on a compounding ratio between the first solvent and the second solvent when preparing a coating solution and a drying temperature and time when forming a coating film. Moreover, a rate of solvent volatilization varies depending on a volume of space to be dried and an amount of exhaust air from solvent vapor, and therefore drying conditions need to be set according to an actual equipment.

A publicly known method can be employed for measuring the amount of residual solvent, for example, gas chromatography can be used. The amount of residual solvent is a mass ratio of the first solvent to a total mass of the photosensitive layer, or a mass ratio of the second solvent.

The solvent includes, for example, alcohol solvents, ketone solvents, ether solvents, ester solvents, and aromatic hydrocarbon solvents. Specifically, the first solvent includes, for example, toluene and xylene (including at least one type of solvents selected from the group consisting of o-xylene, m-xylene and p-xylene). Moreover, the second solvent includes, for example, methyl benzoate, cyclohexanone, and diethylene glycol monoethyl ether acetate. Other solvent can also be combined for use as a solvent other than the first solvent and the second solvent. Specifically, the other solvent includes, for example, tetrahydrofuran and dimethoxymethane.

The boiling point of the first solvent is preferably 90° C. to 150° C., and the boiling point of the second solvent is 153° C. to 230° C. Moreover, in the case of combining the first solvent and the second solvent for use, a boiling point difference of 40° C. to 100° C. is preferred. Moreover, the boiling point of other solvent is preferably 40° C. to 70° C.

The charge transport substance includes, for example, a polycyclic aromatic compound, a heterocyclic compound, a hydrazone compound, a styryl compound, an enamine compound, a benzidine compound, a triarylamine compound, and a resin having a group derived from these substances. Among these, the triarylamine compound and the benzidine compound are preferred, and those having the following structures are preferably used.

(1)

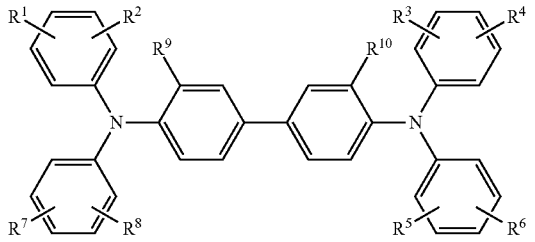

(Wherein $R^1$ to $R^{10}$ represent each independently a hydrogen atom or a methyl group.)

The examples of the structure represented by formula (1) are illustrated in formulae (1-1) to (1-10). Among these, the structures represented by formulae (1-1) to (1-6) are more preferred.

(1-1)

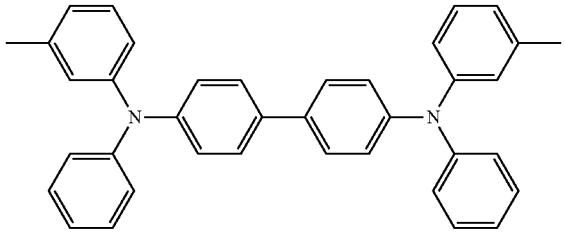

(1-2)

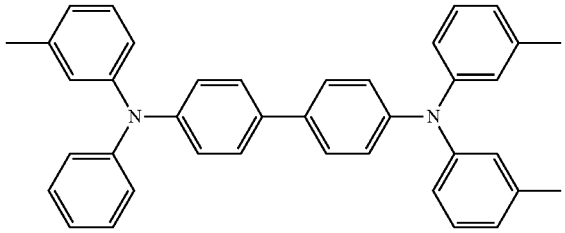

(1-3)

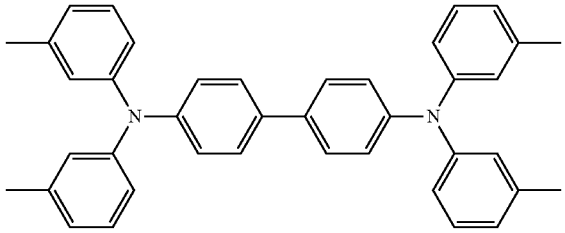

(1-4)

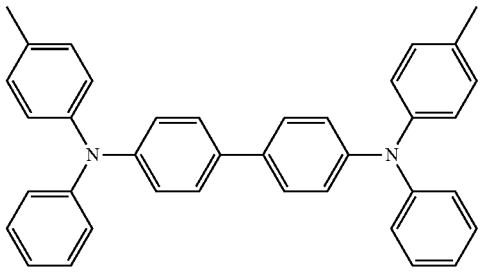

-continued (1-5)

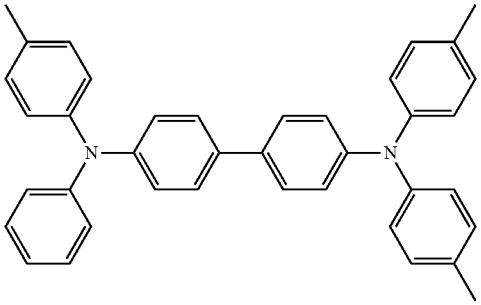

(1-6)

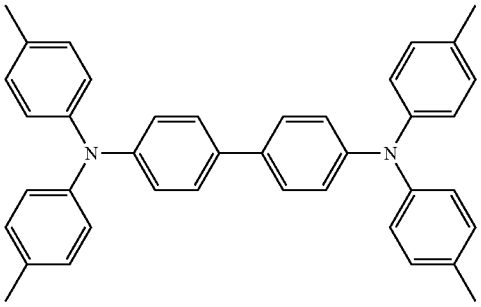

(1-7)

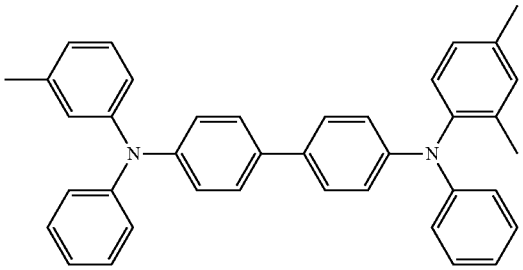

(1-8)

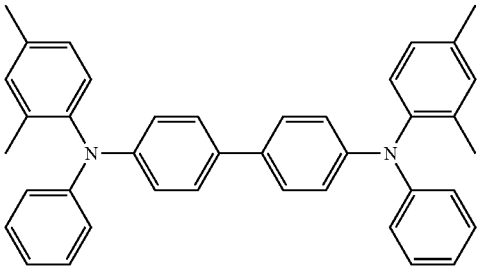

(1-9)

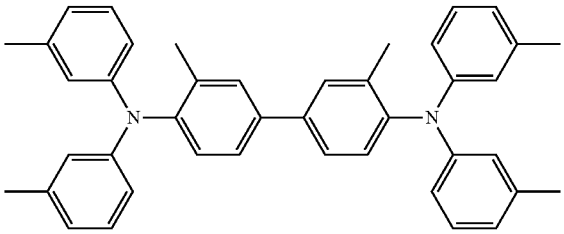

-continued (1-10)

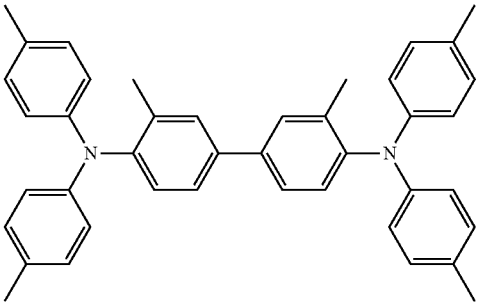

As the resin, a thermoplastic resin is used, and the examples of resins include, for example, a polyester resin, a polycarbonate resin, an acrylic resin, a polystyrene resin, etc. Among these, the polycarbonate resin and the polyester resin are preferred. As the polyester resin, a polyarylate resin is particularly preferable.

The coating solution for the protective layer of the present invention contains a compound having a chain polymerizable functional group.

The protective layer is formed as a cured film by applying this coating solution for the protective layer and polymerizing the compound having the chain polymerizable functional group.

In the present invention, the cured film is formed by step (A) of forming a coating film with a coating solution for the protective layer, irradiating the coating film with radiation, followed by heating at a heating temperature lower than the boiling point of the first solvent. Thereafter, by carrying out step (B) of heating the cured film at a heating temperature higher than the boiling point of the first solvent, a protective layer having a wrinkle shape on the surface is formed.

A unit for polymerizing the compound having a chain polymerizable functional group generally includes a unit using heat, light, and radiation, but in the present invention, radiation and heat are combined for use. When trying to form a cured film by polymerization only with heat, it is generally necessary to treat with high heat for a long time, and since polymerization in the coating film for the protective layer and rapid evaporation of the residual solvent in the photosensitive layer proceed at the same time, a desired wrinkle shape can hardly be obtained. Moreover, even in the case of polymerization by light or radiation, it is necessary to raise a temperature to some extent in order to sufficiently proceed polymerization in a short time and form a cured film. Since radiation has higher energy than light and can efficiently activate polymerizable functional groups, the heating temperature can be lowered and the heating time can be shortened as compared with those by light, and a protective layer can be formed while maintaining an appropriate amount of residual solvent in the photosensitive layer.

The radiation is not particularly limited, and includes, for example, an electron beam.

Irradiation of the electron beam is preferably carried out in a low oxygen atmosphere in order to prevent deactivation of radicalization of the polymerizable functional group. Moreover, step (A) is also preferably carried out in a low oxygen atmosphere in order for preventing deactivation of radicalization and rapid polymerization.

In step (B), it is necessary to heat the cured film at a heating temperature higher than the boiling point of the first solvent. If the heating temperature is lower than the boiling point of the first solvent, wrinkle shaping hardly occurs. Moreover, when step (B) is carried out at a temperature lower than the boiling point of the second solvent, the first solvent evaporates more quickly and the second solvent evaporates later than the first solvent, and therefore a wrinkle shape is finely and uniformly formed, which is preferred.

Although depending on a boiling point of the solvent used, the heating temperature in step (A) is 90° C. to 130° C., and the heating temperature in step (B) is 140° C. to 230° C. Here, the heating temperature refers to an atmospheric temperature upon production of the photosensitive member.

A film thickness of the protective layer according to the present invention is 1.5 μm or less, which can be said to be equivalent to the film thickness of the cured film according to the present invention. The film thickness specified in the present invention refers to a film thickness of the cured film formed in step (A). When the film thickness of the cured film exceeds 1.5 μm, the wrinkle shape tends to be large and non-uniform. When the film thickness of the cured film is 1.0 μm or less, the wrinkle shape becomes finer and more uniform, which is preferred.

The compound having a chain polymerizable functional group may have a molecular structure which exhibits charge transportability in addition to a chain polymerizable functional group. A triarylamine structure is preferred as the molecular structure exhibiting charge transportability. The chain polymerizable functional group is preferably an acryloyl group and a methacryloyl group. The number of functional groups of the compound having the chain polymerizable functional group may be one or more. Of these, if the cured film is formed by combining a compound having a plurality of functional groups and a compound having one functional group for use, the strain generated by the polymerization between the plurality of functional groups is facilitated to be eliminated, which is particularly preferred.

The examples of the aforementioned compound having one functional group are illustrated in formulae (2-1) to (2-6).

(2-1)

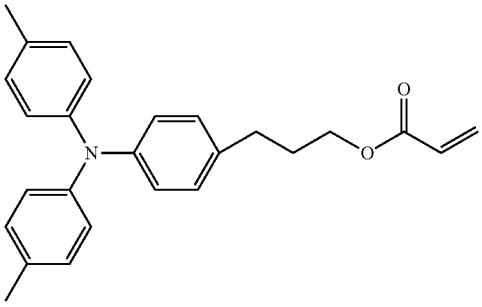

(2-2)

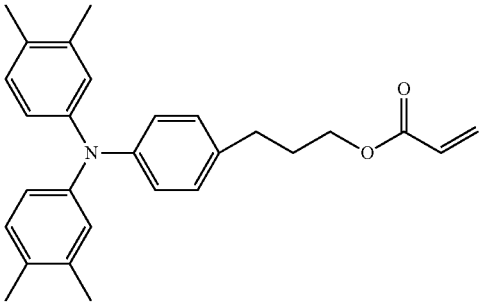

-continued (2-3)

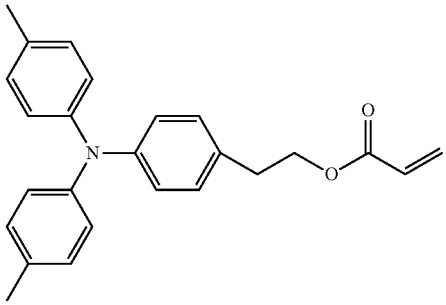

(2-4)

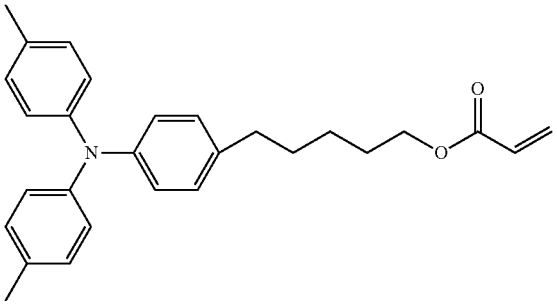

(2-5)

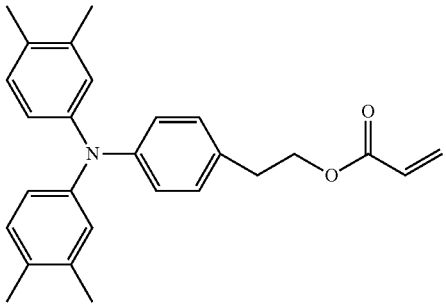

(2-6)

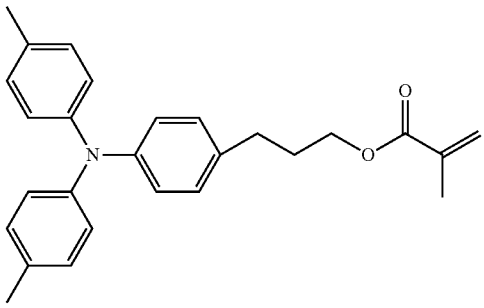

The examples of the aforementioned compound having the plurality of functional groups are illustrated in formulae (3-1) to (3-7).

(3-1)
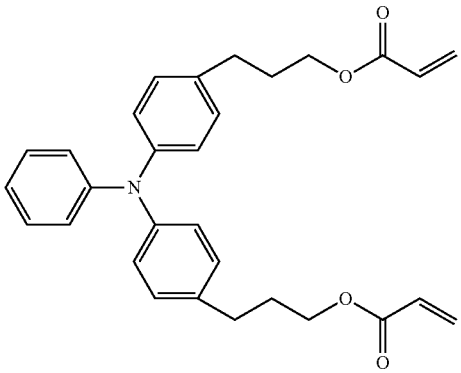
(3-2)
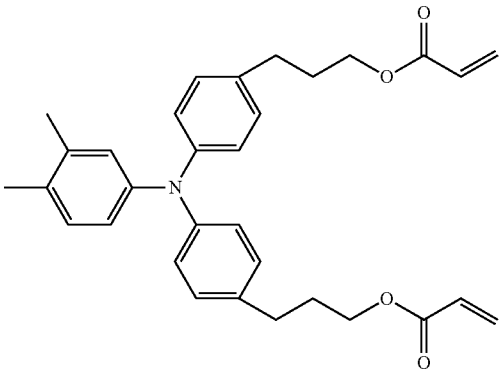
(3-3)
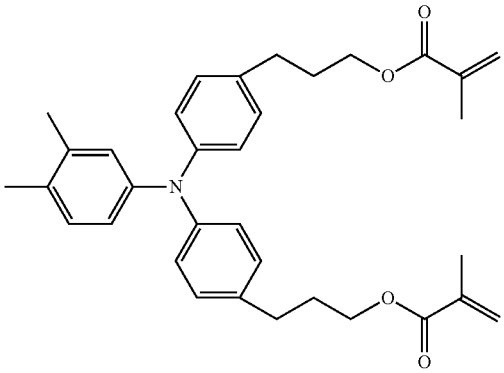
(3-4)
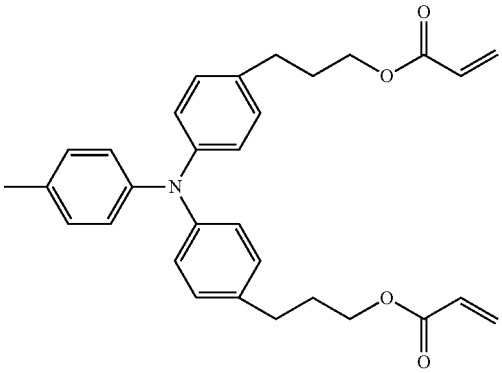
(3-5)
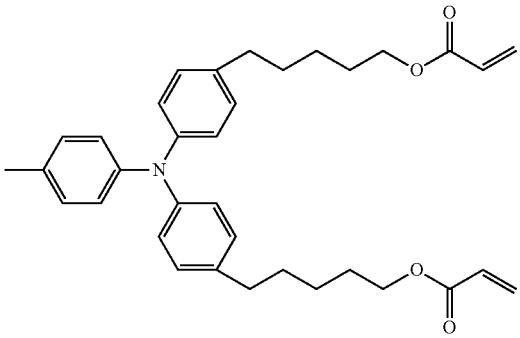
(3-6)
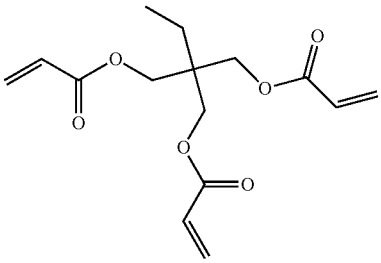
(3-7)
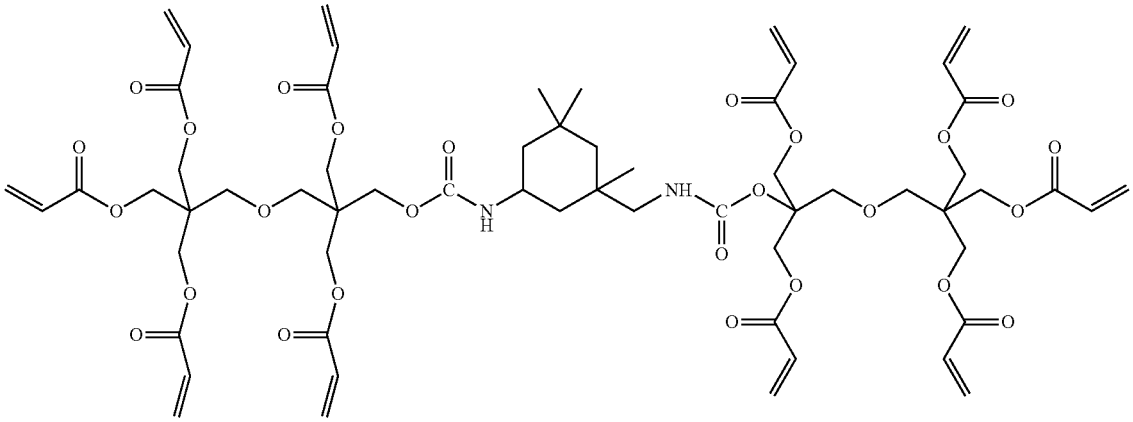

[Electrophotographic Photosensitive Member]

The electrophotographic photosensitive member of the present invention has a support, a photosensitive layer, and a protective layer.

The method for producing an electrophotographic photosensitive member of the present invention includes a method for preparing a coating solution for each layer to be described later, applying the coating solution to a layer in the order of the desired layers and drying the coating solution. In this case, the coating method of the coating solution includes dip coating, spray coating, inkjet coating, roll coating, die coating, blade coating, curtain coating, wire bar coating, ring coating, etc. Among these, the dip coating is preferred from the viewpoint of efficiency and productivity thereof.

Each layer will be described below.

<Support>

In the present invention, the electrophotographic photosensitive member has a support. In the present invention, the support is preferably a conductive support having conductivity. Moreover, the support shape includes, for example, a cylindrical shape, a belt shape, a sheet shape, etc. Above all, the cylindrical support is preferred. Moreover, the surface of the support may be subjected to electrochemical treatment, such as anodic oxidation, blast treatment, cutting treatment, etc.

A material of the support is preferably metal, a resin, glass, etc.

The metal includes, for example, aluminum, iron, nickel, copper, gold, stainless steel, alloys thereof, etc. Of these, an aluminum support using aluminum is preferred.

Moreover, conductivity may be imparted to the resin or the glass by treatment, such as mixing a conductive material or coating therewith.

<Conductive Layer>

In the present invention, a conductive layer may be disposed on the support. By disposing the conductive layer, scratches and a convex-concave shape on the surface of the support can be concealed and reflection of light on the surface of the support can be controlled.

The conductive layer preferably contains a conductive particle and a resin.

A material of the conductive particle includes metal oxide, metal, carbon black, etc.

The metal oxide includes zinc oxide, aluminum oxide, indium oxide, silicon oxide, zirconium oxide, tin oxide, titanium oxide, magnesium oxide, antimony oxide, bismuth oxide, etc. The metal includes aluminum, nickel, iron, nichrome, copper, zinc, silver, etc.

Among these, the metal oxide is preferably used as the conductive particle, and titanium oxide, tin oxide and zinc oxide are particularly preferably used.

When the metal oxide is used as the conductive particle, the surface of the metal oxide may be treated with a silane coupling agent, etc., or the metal oxide may be doped with an element, such as phosphorus or aluminum, or oxide thereof.

Moreover, the conductive particle may constitute a laminated structure having the particle as a core particle and a coating layer covering the core particle. The core particle includes titanium oxide, barium sulfate, zinc oxide, etc. The coating layer includes metal oxides, such as tin oxide.

Further, in the case of using the metal oxide as the conductive particle, the volume-average particle diameter thereof is preferably 1 nm to 500 nm and more preferably 3 nm to 400 nm.

The resin includes, for example, a polyester resin, a polycarbonate resin, a polyvinyl acetal resin, an acrylic resin, a silicone resin, an epoxy resin, a melamine resin, a polyurethane resin, a phenol resin, an alkyd resin, etc.

Moreover, the conductive layer may further contain a masking agent, such as silicone oil, a resin particle, titanium oxide, etc.

An average film thickness of the conductive layer is preferably 1 μm to 50 μm and particularly preferably 3 μm to 40 μm.

The conductive layer can be formed by preparing a coating solution for the conductive layer containing each of the aforementioned materials and the solvents, forming this coating film, and drying this coating film. The solvent used for the coating solution includes alcohol solvents, sulfoxide solvents, ketone solvents, ether solvents, ester solvents, aromatic hydrocarbon solvents, etc. A dispersion method for dispersing the conductive particle in the coating solution for the conductive layer includes a method using a paint shaker, a sand mill, a ball mill, and a liquid collision type high-speed disperser.

<Undercoat Layer>

In the present invention, an undercoat layer may be disposed on the support or the conductive layer. By disposing the undercoat layer, adhesion function between the layers is enhanced, and charge injection blocking function can be imparted.

The undercoat layer preferably contains a resin. Moreover, the undercoat layer may be formed as a cured film by polymerizing a composition containing a monomer having a polymerizable functional group.

The resin includes, for example, a polyester resin, a polycarbonate resin, a polyvinyl acetal resin, an acrylic resin, an epoxy resin, a melamine resin, a polyurethane resin, a phenol resin, a polyvinylphenol resin, an alkyd resin, a polyvinyl alcohol resin, a polyethylene oxide resin, a polypropylene oxide resin, a polyamide resin, a polyamic acid resin, a polyimide resin, a polyamideimide resin, a cellulose resin, etc.

The polymerizable functional group of the monomer having a polymerizable functional group includes, for example, an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, a carbon-carbon double bond group, etc.

Further, the undercoat layer may further contain an electron transport substance, metal oxide, metal, a conductive polymer, etc., for the purpose of enhancing electrical characteristics. Among these, the electron transport substance and the metal oxide are preferably used.

The electron transport substance includes, for example, quinone compounds, imide compounds, benzimidazole compounds, cyclopentadienylidene compounds, fluorenone compounds, xanthone compounds, benzophenone compounds, cyanovinyl compounds, aryl halide compounds, silole compounds, boron-containing compounds, etc. The undercoat layer may be formed as a cured film by using the electron transport substance having the polymerizable functional group as the electron transport substance and copolymerizing with the aforementioned monomer having the polymerizable functional group.

The metal oxide includes, for example, indium tin oxide, tin oxide, indium oxide, titanium oxide, zinc oxide, aluminum oxide, silicon dioxide, etc. The metal includes gold, silver, aluminum, etc.

Further, the undercoat layer may further contain an additive.

An average film thickness of the undercoat layer is preferably 0.1 μm to 50 μm, more preferably 0.2 μm to 40 μm, and particularly preferably 0.3 μm to 30 μm.

The undercoat layer can be formed by preparing a coating solution for the undercoat layer containing each of the aforementioned materials and the solvents, forming this coating film, and drying and/or curing the coating film. The solvent used in the coating solution includes, for example, alcohol solvents, ketone solvents, ether solvents, ester solvents, aromatic hydrocarbon solvents, etc.

<Photosensitive Layer>

The photosensitive layer of the electrophotographic photosensitive member is mainly classified into (1) a laminated photosensitive layer and (2) a single-layer photosensitive layer. The laminated photosensitive layer (1) has a charge generation layer containing a charge generation substance and a charge transport layer containing the charge transport substance. The single-layer photosensitive layer (2) has a photosensitive layer containing both the charge generation substance and the charge transport substance. The present invention is preferably applied for producing a photosensitive member having a laminated photosensitive layer.

(1) Laminated Photosensitive Layer

The laminated photosensitive layer has the charge generation layer and the charge transport layer.

(1-1) Charge Generation Layer

The charge generation layer preferably contains the charge generation substance and a resin.

The charge generation substance includes, for example, azo pigments, perylene pigments, polycyclic quinone pigments, indigo pigments, phthalocyanine pigments, etc. Among these, the azo pigments and the phthalocyanine pigments are preferred. Among the phthalocyanine pigments, oxytitanium phthalocyanine pigments, chlorogallium phthalocyanine pigments, and hydroxygallium phthalocyanine pigments are preferred.

The content of the charge generation substance in the charge generation layer is preferably 40% to 85% by mass, and more preferably 60% to 80% by mass based on the total mass of the charge generation layer.

The resin includes, for example, a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, a polyvinyl chloride resin, etc., with the polyvinyl butyral resin being more preferred among them.

Moreover, the charge generation layer may further contain additives, such as an antioxidant and an ultraviolet absorber. Specifically, hindered phenol compounds, hindered amine compounds, sulfur compounds, phosphorus compounds, benzophenone compounds, etc., are included.

The average film thickness of the charge generation layer is preferably 0.1 μm to 1 μm, and more preferably 0.15 μm to 0.4 μm.

The charge generation layer can be formed by preparing a coating solution for the charge generation layer containing each of the aforementioned materials and the solvents, forming this coating film, and drying the coating film. The solvent to be used for the coating solution includes, for example, alcohol solvents, sulfoxide solvents, ketone solvents, ether solvents, ester solvents, aromatic hydrocarbon solvents, etc.

(1-2) Charge Transport Layer

When the present invention is the laminated photosensitive layer, step (i) according to the present invention is forming a photosensitive layer having the charge generation layer and the charge transport layer in this order on the support.

The charge transport layer is obtained via forming of a coating film for the charge transport layer obtained by a coating solution for the charge transport layer containing the first solvent, the second solvent having a boiling point higher than that of the first solvent, the charge transport substance, and the resin. By heating the coating film for the charge transport layer, the amount of residual solvent of the first solvent in the charge transport layer is 0.05% to 2.50% by mass, and the amount of residual solvent of the second solvent in the charge transport layer needs to be 0.50% to 2.50% by mass. Moreover, the amount of residual solvent is a mass ratio of the first solvent to a total mass of the charge transport layer, or a mass ratio of the second solvent.

A content of the charge transport substance in the charge transport layer is preferably 25% to 70% by mass, and more preferably 30% to 55% by mass based on a total mass of the charge transport layer.

A content ratio (mass ratio) between the charge transport substance and the resin is preferably 4:10 to 20:10 and more preferably 5:10 to 12:10.

Moreover, the charge transport layer may contain additives, such as an antioxidant, an ultraviolet absorber, a plasticizer, a leveling agent, a slipperiness-imparting agent and an abrasion resistance improving agent. Specifically, the additive includes, for example, a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle, a boron nitride particle, etc.

An average film thickness of the charge transport layer is preferably 5 to 50 μm, more preferably 8 μm to 40 μm, and particularly preferably 10 μm to 30 μm.

(2) Single-Layer Photosensitive Layer

In the case of the present invention being the single-layer photosensitive layer, step (i) is carried out via forming of a coating film for the photosensitive layer obtained by a coating solution for the photosensitive layer containing the first solvent, the second solvent having a boiling point higher than that of the first solvent, the charge generation substance, the charge transport substance, and the resin. By heating the coating film for the photosensitive layer, the amount of residual solvent of the first solvent in the photosensitive layer is 0.05% to 2.50% by mass, and the amount of residual solvent of the second solvent in the photosensitive layer needs to be 0.50% to 2.50% by mass.

The charge generation substance, the charge transport substance, and the resin are the same as the examples of the materials in the above "(1) Laminated photosensitive layer".

<Protective Layer>

In the present invention, the protective layer is disposed on the photosensitive layer in step (ii). The protective layer is formed as a cured film by polymerizing a composition containing a compound having the polymerizable functional group.

The protective layer preferably further contains a conductive particle and/or a charge transport substance and a resin.

The conductive particle includes particulate metal oxides, such as titanium oxide, zinc oxide, tin oxide, indium oxide, etc.

The charge transport substance includes polycyclic aromatic compounds, heterocyclic compounds, hydrazone compounds, styryl compounds, enamine compounds, benzidine compounds, triarylamine compounds, and resins having groups derived from these substances, with the triarylamine compounds and the benzidine compounds being preferred among them.

The resin includes a polyester resin, an acrylic resin, a phenoxy resin, a polycarbonate resin, a polystyrene resin, a phenol resin, a melamine resin, an epoxy resin, etc. Of these, the polycarbonate resin, the polyester resin and the acrylic resin are preferred.

The protective layer may contain additives, such as an antioxidant, an ultraviolet absorber, a plasticizer, a leveling agent, a slipperiness-imparting agent, and an abrasion resistance improving agent. Specifically, a hindered phenol compound, a hindered amine compound, a sulfur compound, a phosphorus compound, a benzophenone compound, a siloxane-modified resin, silicone oil, a fluororesin particle, a polystyrene resin particle, a polyethylene resin particle, a silica particle, an alumina particle, a boron nitride particle, etc., are included.

The protective layer can be formed by preparing a coating solution for the protective layer containing each of the aforementioned materials and the solvents, forming this coating film, and drying and/or curing the coating film. The solvent used for the coating solution includes alcohol solvents, ketone solvents, ether solvents, sulfoxide solvents, ester solvents, and aromatic hydrocarbon solvents.

[Process Cartridge and Electrophotographic Apparatus]

The process cartridge of the present invention is characterized in that the process cartridge integrally supports the electrophotographic photosensitive member described so far and at least one unit selected from the group consisting of a charging unit, a developing unit, a transferring unit and a cleaning unit, and can easily be removably attached to a main body of an electrophotographic apparatus.

Moreover, the electrophotographic apparatus of the present invention is characterized in that the electrophotographic apparatus has the electrophotographic photosensitive member, the charging unit, the exposure unit, the developing unit and the transferring unit described so far.

Figure 2:
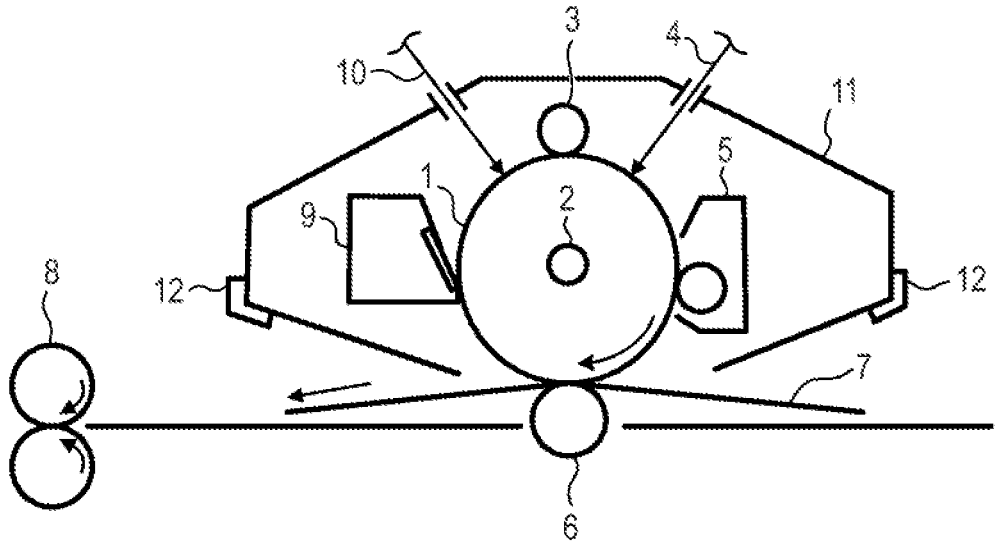
FIG. 2 is a schematic configuration view of an electrophotographic apparatus provided with a process cartridge having an electrophotographic photosensitive member.

FIG. 2 illustrates an example of the schematic configuration of the electrophotographic apparatus having the process cartridge equipped with the electrophotographic photosensitive member.

Reference numeral 1 denotes a cylindrical electrophotographic photosensitive member, which is rotationally driven at a predetermined peripheral speed in a direction indicated by the arrow about a shaft 2 as a center. The surface of the electrophotographic photosensitive member 1 is charged to a predetermined positive or negative potential by a charging unit 3. It is noted that although a roller charging system based on a roller-type charging member is illustrated in the figure, a charging system such as a corona charging method, a proximity charging method, or an injection charging method, etc., may be adopted. The charged surface of electrophotographic photosensitive member 1 is irradiated by exposure light 4 from an exposure unit (not shown), and hence an electrostatic latent image corresponding to the target image information is formed thereon. The electrostatic latent image formed on the surface of the electrophotographic photosensitive member 1 is developed with toner stored in a developing unit 5, and hence a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, undergoes treatment for fixing the toner image, and is printed out to the outside of the electrophotographic apparatus. The electrophotographic apparatus may include a cleaning unit 9 for removing deposits, such as the toner remaining on the surface of the electrophotographic photosensitive member 1 after the transfer. Moreover, a so-called cleaner-less system configured to remove the deposits with the developing unit, etc., without separate arrangement of the cleaning unit may be used. The electrophotographic apparatus may include an antistatic mechanism configured to subject the surface of the electrophotographic photosensitive member 1 to antistatic treatment with pre-exposure light 10 from a pre-exposure unit (not shown). Further, in order to removably mount a process cartridge 11 of the present invention onto the main body of the electrophotographic apparatus, a guiding unit 12, such as a rail, may be disposed.

The electrophotographic photosensitive member of the present invention can be used for a laser beam printer, an LED printer, a copying machine, a facsimile, and a multifunction machine thereof.

EXAMPLES

The present invention will be described in more detail by way of Examples and Comparative Examples below. The present invention is not limited to the following examples so long as the present invention does not exceed the gist thereof. In the description of the following examples, the term "part" is based on mass unless otherwise specified.

<Production of Electrophotographic Photosensitive Member>

Example 1

An aluminum cylinder (JIS-A3003, aluminum alloy) having a diameter of 24 mm and a length of 257.5 mm was used as a support (the conductive support).

Next, the following materials were prepared.

Titanium oxide ($TiO_2$) particle (average primary particle diameter of 230 nm) coated with oxygen-deficient tin oxide ($SnO_2$) as a metal oxide particle: 214 parts Phenol resin (monomer/oligomer of the phenol resin) as a binder material (trade name: Pryofen J-325 manufactured by DIC Corporation, resin solid content: 60% by mass): 132 parts As a solvent, 1-methoxy-2-propanol: 98 parts The above those materials were charged in a sand mill by using 450 parts of glass beads each having a diameter of 0.8 mm and dispersed under conditions of a rotation speed of 2000 rpm, a dispersion treatment time of 4.5 hours, and a set temperature of cooling water of 18° C. to obtain a dispersion solution. The glass beads were removed from this dispersion solution with a mesh (opening of mesh: 150 μm). To the dispersion solution obtained, a silicone resin particle (trade name: Tospearl 120 manufactured by Momentive Performance Materials Inc., the average particle size: 2 μm) serving as a surface roughness-imparting material was added. An amount of the silicone resin particle added was set to 10% by mass based on the total mass of the metal oxide particle and the binder material in the dispersion solution after removing the glass beads. Moreover, silicone oil as a leveling agent (trade name: SH28PA, manufactured by Dow Corning Toray Co., Ltd.) was added to the dispersion solution so that the amount of silicone oil was 0.01% by mass based on the total mass of the particulate metal oxide and the binder material in the dispersion solution. Next, a mixed solvent of methanol and 1-methoxy-2-propanol (mass ratio 1:1) was added to the dispersion solution so that a total mass of the particulate metal oxide, the binder material, and the surface roughness-imparting material in the dispersion solution (i.e., the mass of a solid content) was 67% by mass based on the mass of the dispersion solution. Thereafter, a coating solution for the conductive layer was prepared by stirring. The support was dip-coated thereon with this coating solution for the conductive layer and the coating support was heated at 140° C. for 1 hour to form a conductive layer having a film thickness of 30 μm.

Next, the following materials were prepared.

Electron transport material (formula E-1): 4 parts

Blocked isocyanate (trade name: Duranate SBN-70D, manufactured by Asahi Kasei Chemicals Corporation): 5.5 parts Polyvinyl butyral resin (Eslec KS-5Z, manufactured by Sekisui Chemical Co., Ltd.): 0.3 parts Zinc (II) hexanoate as a catalyst (manufactured by Mitsuwa Chemical Co., Ltd.): 0.05 parts The above those materials were dissolved in a mixed solvent of 50 parts of tetrahydrofuran and 50 parts of 1-methoxy-2-propanol to prepare a coating solution for the undercoat layer. The conductive layer was dip-coated thereon with this coating solution for the undercoat layer and the coating layer was heated at 170° C. for 30 minutes to form an undercoat layer having a film thickness of 0.7 μm.

(E-1)

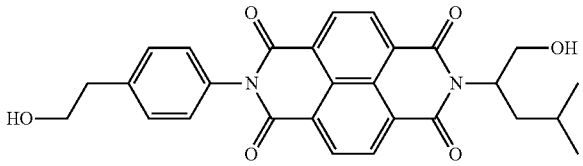

Next, 10 parts of crystalline hydroxygallium phthalocyanine having peaks at the positions of 7.5° and 28.4° in a chart obtained from CuKα characteristic X-ray diffraction and 5 parts of a polyvinyl butyral resin (trade name: Eslec BX-1, manufactured by Sekisui Chemical Co., Ltd.) were prepared and added to 200 parts of cyclohexanone, and the mixed solution was dispersed for 6 hours in a sand mill apparatus by using glass beads each having a diameter of 0.9 mm. To the dispersion solution, 150 parts of cyclohexanone and 350 parts of ethyl acetate were further added for dilution to obtain a coating solution for the charge generation layer. The undercoat layer was dip-coated thereon with the obtained coating solution and the coating layer was dried at 95° C. for 10 minutes to form a charge generation layer having a film thickness of 0.20 μm.

X-ray diffraction measurement was carried out under the following conditions.

[Powder X-Ray Diffraction Measurement]

Measurement apparatus used: X-ray diffractometer RINT-TTRII manufactured by Rigaku Denki Co., Ltd.

X-ray tube: Cu

Tube voltage: 50 KV

Tube current: 300 mA

Scan method: 2θ/θ scan

Scan speed: 4.0°/min

Sampling interval: 0.02°

Start angle (2θ): 5.0°

Stop angle (2θ): 40.0°

Attachment: Standard sample holder

Filter: Not used

Incident monochrome: Used

Counter monochromator: Not used

Divergence slit: Open

Divergence vertical limiting slit: 10.00 mm

Scattering slit: Open

Light receiving slit: Open

Flat plate monochromator: Used

Counter: Scintillation counter

Next, the following materials were prepared.

Charge transport substance (hole transport substance) represented by aforementioned structural formula (1-1): 5 parts Charge transport substance (hole transport substance) represented by aforementioned structural formula (1-3): 5 parts Polycarbonate (trade name: Iupilon Z400, manufactured by Mitsubishi Engineering-Plastics Corporation): 10 parts Polycarbonate resin having copolymerization units of following structural formula (C-4) and following structural formula (C-5): 0.02 parts (x/y=0.95/0.05: viscosity-average molecular mass=20000)

The above those materials were dissolved in a mixed solvent (60 parts of toluene/2.3 parts of methyl benzoate/12.8 parts of tetrahydrofuran) (first solvent: toluene, boiling point of 110.6° C. and second solvent: methyl benzoate, boiling point of 199.6° C.) to prepare a coating solution for the charge transport layer. The charge generation layer was dip-coated thereon with the coating solution for the charge transport layer to form a coating film for the charge transport layer, and the coating film was dried at 100° C. for 20 minutes to form a charge transport layer having a film thickness of 16 μm.

(C-4)

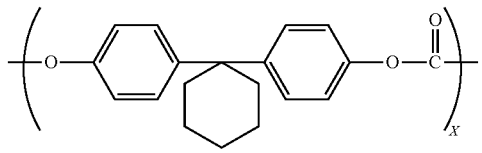

(C-5)

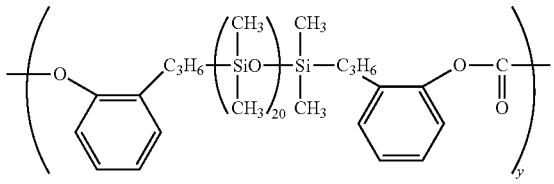

The amount of residual solvent in the charge transport layer was measured by a gas chromatography-mass spectrometer equipped with a headspace sampler (HP6890/HP5973 manufactured by Hewlett-Packard Company). As measurement conditions for gas chromatography-mass spectrometry, by using the headspace sampler, the charge transport layer was stripped off from the electrophotographic photosensitive member and heated at 150° C. for 30 minutes, and generated gas therefrom was measured with the gas chromatography-mass spectrometer (HP6890/HP5973 manufactured by Hewlett Packard Company) equipped with a capillary column (HP-5MS manufactured by Hewlet Packard Company, a copolymer having 5% of diphenylpolysiloxane and 95% of dimethylpolysiloxane, thickness of 0.25 μm, inner diameter of 0.25 mm and length of 30 m), by using carrier gas (He: 1 ml/min), holding a sample at 40° C. for 3 minutes, then heating up the column from 40° C. to 70° C. at a rate of temperature rise of 2° C./min for the first stage temperature rise, heating the column from 70° C. to 150° C. at a rate of temperature rise of 5° C./min for the second stage temperature rise, and heating up the column from 150° C. to 300° C. at a rate of temperature rise of 10° C./min for the third stage temperature rise. A calibration curve was prepared by using the solvent used in the charge transport layer as a reference substance for the calibration curve, and the amount of residual solvent in the charge transport layer was determined. The results are shown in Table 1.

Next, the following materials were prepared.

Compound represented by aforementioned structural formula (2-1): 8 parts

Compound represented by aforementioned structural formula (3-1): 16 parts

Siloxane-modified acrylic compound (Cymac US270, manufactured by Toagosei Co., Ltd.): 0.1 parts The above those materials were mixed with 58 parts of cyclohexane and 25 parts of 1-propanol and stirred. A coating solution for the protective layer was prepared in such a manner.

The charge transport layer was dip-coated thereon with this coating solution for the protective layer to form a coating film for the protective layer, and the obtained coating film was dried at 40° C. for 5 minutes. Thereafter, the coating film was irradiated with an electron beam for 1.6 seconds while rotating the support (irradiated body) at a speed of 300 rpm under conditions of an acceleration voltage of 70 kV and a beam current of 5.0 mA under a nitrogen atmosphere. A dose at the position of the outermost surface layer was 15 kGy. Then, in a nitrogen atmosphere, a temperature was raised from 25° C. to 100° C. over 20 seconds as heat treatment to form a cured film having a film thickness of 1.5 μm (step (A)). An oxygen concentration from the electron beam irradiation to the subsequent heat treatment was 10 ppm or less. Next, the coating film was naturally cooled in the air until the temperature of the coating film reached 25° C. and then heated at 220° C. for 15 minutes in the air to form a protective layer having wrinkle shapes on the surface (step (B)). A cylindrical (drum-shaped) electrophotographic photosensitive member having the protective layer of Example 1 was fabricated.

Examples 2 to 20

Charge transport layers each was formed in the same manner as in Example 1 except that the type and amount of each compound in the formation of the charge transport layer, the type and amount of solvent in the formation of the charge transport layer, and the drying conditions in the formation of the charge transport layer were changed as shown in Table 1. Further, protective layers each was formed in the same manner as in Example 1 except that the type and amount of each compound in the formation of the protective layer, the film thickness of the cured film, and the heating temperature conditions were changed as shown in Table 2, and electrophotographic photosensitive members each was fabricated.

Example 21

An electrophotographic photosensitive member was fabricated in the same manner as in Example 1 except that the charge transport layer was formed as follows and the type of each compound and production conditions of the protective layer were changed as shown in Table 1.

Charge transport substance (hole transport substance) represented by aforementioned structural formula (1-1): 5 parts Charge transport substance (hole transport substance) represented by aforementioned structural formula (1-2): 5 parts Polyarylate resin having a repeating structural unit represented by following formula (16-1) and a repeating structural unit represented by following formula (16-2) at a ratio of 5/5 and having a mass-average molecular mass (Mw) of 100,000:10 parts (16-1)

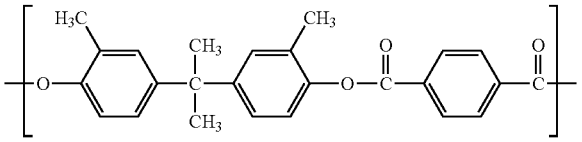

(16-2)

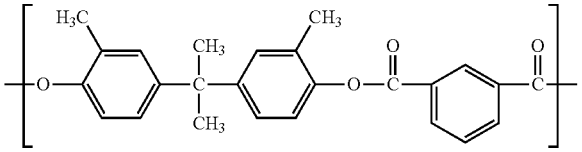

Polycarbonate resin having copolymerization units of aforementioned structural formula (C-4) and aforementioned structural formula (C-5): 0.02 parts (x/y=0.95/0.05: viscosity-average molecular mass=20000)

By dissolving the above those compounds in a mixed solvent (45 parts of toluene/15 parts of methyl benzoate/15 parts of tetrahydrofuran) (first solvent: toluene, boiling point of 110.6° C. and second solvent: methyl benzoate, boiling point of 199.6° C.), a coating solution for the charge transport layer was prepared. The charge generation layer was dip-coated thereon with the coating solution for the charge transport layer to form a coating film, and the coating film was dried at 100° C. for 30 minutes to form a charge transport layer having a film thickness of 16 μm.

(C-4)

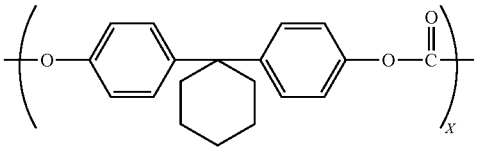

(C-5)

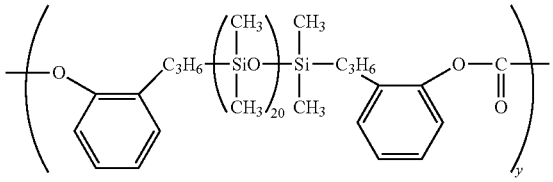

Comparative Examples 1 to 3, 5 and 7

Electrophotographic photosensitive members each was fabricated in the same manner as in Example 1 except that the amount, the type of each compound, etc., were changed as shown in Tables 1 and 2.

Comparative Example 4

Various conditions for forming the charge transport layer were the same as in Example 1 except being changed as shown in Table 1. In the step of forming the protective layer, heating in step (A) was not carried out after irradiation with radiation. Thereafter, heating was carried out in the air at 160° C. for 15 minutes in step (B) to form a protective layer having a film thickness of 1.5 μm. Other conditions in step (ii) of forming the protective layer were the same as in Example 1.

Comparative Example 6

Various conditions for forming the charge transport layer were the same as in Example 1 except being changed as shown in Table 1. In the step of forming the protective layer, a dose after irradiation with radiation at the position of the outermost surface layer was 15 kGy. Then, in a nitrogen atmosphere, a temperature was raised from 25° C. to 230° C. over 20 seconds as heat treatment in step (A) to form a cured film having a film thickness of 1.5 μm. The oxygen concentration from the electron beam irradiation to the completion of subsequent step (A) was 10 ppm or less.

This cured film was used as a protective layer without carrying out step (B). Other conditions in the step of forming the protective layer were the same as in Example 1.

<Evaluation>

The photosensitive members fabricated in Examples 1 to 21 and the photosensitive members fabricated in Comparative Examples 1 to 7 were used for evaluation under the following conditions.

Observation of shape formed

A surface shape of the electrophotographic photosensitive member was magnified and observed with a laser microscope (VK-X200 manufactured by KEYENCE CORPORATION), and it was verified whether the wrinkle shape as shown in FIG. 1 was formed. The results are shown in Table 3.

Measurement of wrinkle pitch in wrinkle shape

As measurement of a wrinkle pitch, a cross-sectional curve was measured under the following conditions by using a surface roughness meter, and an average value of intervals between all adjacent convex portions was obtained. The measurement was carried out in the same manner at arbitrary 10 points, and an average value of the values of the 10 points was taken as a pitch of wrinkle shape in each photosensitive member. Moreover, a difference between the maximum value and the minimum value of each 10-point pitch average value was obtained, which was taken as a variation of the average pitch. The results are shown in Table 3.

Roughness meter apparatus name: SE3500 (manufactured by Kosaka Laboratory Ltd.)
Cutoff value: 0.08 mm
Spare length: Cutoff×1
Filter characteristics: 2CR
Evaluation length: 1.0 mm
Vertical magnification: 10000
Lateral Magnification: 50
Feed length: 0.1 mm/sec
Leveling: Straight line (entire area)
Compliant with JISB0601-1982
Evaluation length when processing the whole curve to be measured: Interval length of 8000 equal parts into which the whole curve was divided
λs filter: None
Polarity: Normal Relative value evaluation of torque and image evaluation The photosensitive members fabricated in Examples 1 to 21 and the photosensitive members fabricated in Comparative Examples 1 to 7 were used for evaluation under the following conditions.

As an electrophotographic apparatus, a modified machine of a laser beam printer manufactured by Hewlett-Packard Company, trade name HP LaserJet Enterprise Color M553dn, was used. The apparatus was modified so that a driving current value of the rotary motor for the photosensitive member could be measured, a voltage applied to a charging roller could be adjusted and measured, and quantity of image exposure light could be adjusted and measured.

The photosensitive members of Examples and Comparative Examples were each mounted on a cyan cartridge of the image forming apparatus.

A test chart with a printing ratio of 5% was used and 100 sheets of the images thereof were output on A4-size regular paper. As a charging condition, the dark portion potential was set to −500 V, and as a light exposure condition, quantity of image exposure light was set to 0.25 μJ/cm$^2$. The driving current value (current value A) upon output of 100 sheets was read. It is indicated that the larger the obtained current value is, the larger frictional force between the electrophotographic photosensitive member and the cleaning blade becomes.

Furthermore, an electrophotographic photosensitive member as a control of a relative torque value was fabricated by the following method. Without carrying out step (B) in production of the electrophotographic photosensitive member of Example 1, an electrophotographic photosensitive member without wrinkles was formed and was used as a control electrophotographic photosensitive member. By using the control electrophotographic photosensitive member fabricated, the driving current value (the current value B) of the rotary motor for the electrophotographic photosensitive member was measured in the same manner as in Example 1.

The ratio of the driving current value (the current value A) of the rotary motor for the electrophotographic photosensitive member thus obtained to the driving current value (the current value B) was calculated. The calculated value of (the current value A)/(the current value B) was used as a torque relative value for comparison. It is indicated that the smaller the relative value is, the more the frictional force between the electrophotographic photosensitive member and the cleaning blade is reduced.

The evaluation results are shown in Table 3.

Reference Example 1

Figure 3:
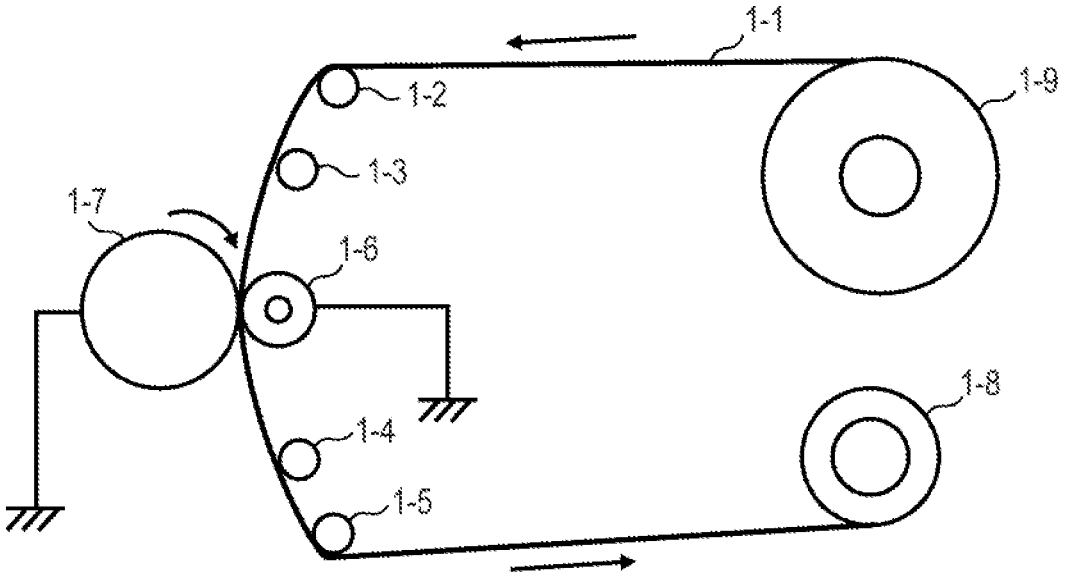
FIG. 3 is a schematic configuration view of an apparatus for polishing a surface of an electrophotographic photosensitive member.

A photosensitive member without wrinkle formation was fabricated without carrying out step (B) in production of the photosensitive member of Example 1. The surface of the photosensitive member was polished under the following conditions by using the polishing machine shown in FIG. 3.

Polishing sheet feed speed: 400 mm/min
Photosensitive member rotation speed: 240 rpm
Polishing abrasive grain: Silicon carbide
Average grain size of polishing abrasive grain: 3 μm Polishing time: 20 seconds In the polishing method, the surface of an electrophotographic photosensitive member 1-7 was subjected to roughening treatment by rotating while pressing a photosensitive member 1-7 for 20 seconds in a direction of the arrow while sending a polishing sheet 1-1 provided with a layer in which the polishing abrasive grains were dispersed in the binder resin on the base material sheet, in a direction of the arrow. A surface roughness Ra of the photosensitive member after the surface roughening was evaluated under the same conditions as those employed for the wrinkle pitch measurement and the surface roughness was found to be 0.018 μm. The torque relative value of this photosensitive member was found to be 0.67. Here, reference numerals 1-2 to 1-5 in FIG. 3 denote guide rollers, reference numeral 1-6 denotes a backup roller, reference numeral 1-8 denotes a feeding roller, and reference numeral 1-9 denotes a winding roller.

TABLE 1

| | Charge transport layer | | | | | | | | | |
|---|---|---|---|---|---|---|---|---|---|---|
| | Charge transport substance | | | | First solvent | | | Second solvent | | |
| | Type | Part by mass | Type | Part by mass | Type | Boiling point (° C.) | Part by mass | Type | Boiling point (° C.) | Part by mass |
| Example 1 | (1-1) | 5 | (1-3) | 5 | Toluene | 110.63 | 60 | Methyl benzoate | 199.6 | 2.3 |
| Example 2 | (1-1) | 5 | (1-2) | 5 | O-xylene | 144 | 60 | Methyl benzoate | 199.6 | 2.3 |
| Example 3 | (1-1) | 5 | (1-4) | 5 | O-xylene | 144 | 30 | Methyl benzoate | 199.6 | 30 |
| Example 4 | (1-1) | 5 | (1-3) | 5 | Toluene | 110.63 | 60 | Methyl benzoate | 199.6 | 3.8 |
| Example 5 | (1-1) | 5 | (1-3) | 5 | Toluene | 110.63 | 45 | Cyclohexanone | 155.65 | 22.5 |
| Example 6 | (1-1) | 5 | (1-3) | 5 | Toluene | 110.63 | 45 | Methyl benzoate | 199.6 | 15 |
| Example 7 | (1-4) | 5 | (1-6) | 5 | Toluene | 110.63 | 60 | Methyl benzoate | 199.6 | 2.3 |
| Example 8 | (1-1) | 5 | (1-3) | 5 | O-xylene | 144 | 60 | Diethylene glycol monoethyl ether acetate | 217.4 | 2.3 |
| Example 9 | (1-1) | 5 | (1-3) | 5 | O-xylene | 144 | 45 | Methyl benzoate | 199.6 | 15 |
| Example 10 | (1-1) | 5 | (1-3) | 5 | Toluene | 110.63 | 45 | Cyclohexanone | 155.65 | 15 |
| Example 11 | (1-1) | 5 | (1-6) | 5 | Toluene | 110.63 | 45 | Methyl benzoate | 199.6 | 15 |
| Example 12 | (1-4) | 5 | (1-6) | 5 | Toluene | 110.63 | 45 | Methyl benzoate | 199.6 | 15 |
| Example 13 | (1-1) | 5 | (1-3) | 5 | O-xylene | 144 | 45 | Diethylene glycol monoethyl ether acetate | 217.4 | 7.5 |
| Example 14 | (1-1) | 5 | (1-3) | 5 | Toluene | 110.63 | 45 | Methyl benzoate | 199.6 | 15 |
| Example 15 | (1-1) | 5 | (1-3) | 5 | O-xylene | 144 | 45 | Methyl benzoate | 199.6 | 15 |
| Example 16 | (1-1) | 5 | (1-3) | 5 | Toluene | 110.63 | 45 | Methyl benzoate | 199.6 | 15 |
| Example 17 | (1-4) | 5 | (1-6) | 5 | Toluene | 110.63 | 45 | Methyl benzoate | 199.6 | 15 |
| Example 18 | (1-1) | 5 | (1-3) | 5 | Toluene | 110.63 | 45 | Methyl benzoate | 199.6 | 3.8 |
| Example 19 | (1-1) | 5 | (1-3) | 5 | Toluene | 110.63 | 30 | Methyl benzoate | 199.6 | 30 |
| Example 20 | (1-3) | 5 | (1-5) | 5 | Toluene | 110.63 | 45 | Methyl benzoate | 199.6 | 15 |
| Example 21 | (1-1) | 5 | (1-2) | 5 | Toluene | 110.63 | 45 | Methyl benzoate | 199.6 | 15 |
| Comparative Example 1 | (1-1) | 5 | (1-3) | 5 | Toluene | 110.63 | 75 | — | — | 0 |
| Comparative Example 2 | (1-1) | 5 | (1-3) | 5 | Tetrahydrofuran | 66 | 37.5 | Toluene | 110.63 | 37.5 |
| Comparative Example 3 | (1-1) | 5 | (1-3) | 5 | Toluene | 110.63 | 45 | Methyl benzoate | 199.6 | 15 |
| Comparative Example 4 | (1-1) | 5 | (1-3) | 5 | Toluene | 110.63 | 45 | Cyclohexanone | 155.65 | 22.5 |
| Comparative Example 5 | (1-1) | 5 | (1-2) | 5 | Toluene | 110.63 | 45 | Cyclohexanone | 155.65 | 22.5 |
| Comparative Example 6 | (1-1) | 5 | (1-3) | 5 | Toluene | 110.63 | 45 | Methyl benzoate | 199.6 | 15 |
| Comparative Example 7 | (1-1) | 5 | (1-4) | 5 | Toluene | 110.63 | 45 | Cyclohexanone | 155.65 | 11.3 |

| | Charge transport layer | | | | | | |
|---|---|---|---|---|---|---|---|
| | Other solvent | | | | Amount of residual solvent of | Amount of residual solvent of | Ratio of amount of residual solvent |
| | Type | Boiling point (° C.) | Part by mass | Drying conditions | first solvent (% by mass) | second solvent (% by mass) | (second solvent/first solvent) |
| Example 1 | Tetrahydrofuran | 66 | 12.8 | 100° C. 20 min | 1.05 | 0.50 | 0.48 |
| Example 2 | Dimethoxymethane | 42 | 12.8 | 125° C. 20 min | 1.10 | 0.51 | 0.46 |
| Example 3 | Dimethoxymethane | 42 | 22.5 | 130° C. 30 min | 0.05 | 2.08 | 41.60 |
| Example 4 | Tetrahydrofuran | 66 | 11.3 | 100° C. 30 min | 1.02 | 0.80 | 0.78 |

TABLE 1-continued

| | | | | | | | |
|---|---|---|---|---|---|---|---|
| Example 5 | Dimethoxymethane | 42 | 7.5 | 100° C. 30 min | 0.32 | 1.70 | 5.31 |
| Example 6 | Dimethoxymethane | 42 | 15 | 100° C. 30 min | 0.30 | 1.71 | 5.70 |
| Example 7 | Tetrahydrofuran | 66 | 12.8 | 100° C. 20 min | 1.00 | 0.50 | 0.50 |
| Example 8 | Tetrahydrofuran | 66 | 12.8 | 125° C. 20 min | 1.05 | 0.50 | 0.48 |
| Example 9 | Dimethoxymethane | 42 | 15 | 125° C. 30 min | 0.30 | 1.74 | 5.80 |
| Example 10 | Dimethoxymethane | 42 | 15 | 100° C. 30 min | 0.32 | 1.72 | 5.38 |
| Example 11 | Dimethoxymethane | 42 | 15 | 110° C. 30 min | 0.32 | 1.73 | 5.41 |
| Example 12 | Dimethoxymethane | 42 | 15 | 110° C. 30 min | 0.33 | 1.70 | 5.15 |
| Example 13 | Tetrahydrofuran | 66 | 22.5 | 120° C. 20 min | 2.00 | 2.50 | 1.25 |
| Example 14 | Tetrahydrofuran | 66 | 15 | 100° C. 30 min | 0.30 | 1.70 | 5.67 |
| Example 15 | Dimethoxymethane | 42 | 15 | 125° C. 30 min | 0.29 | 1.70 | 5.86 |
| Example 16 | Tetrahydrofuran | 66 | 15 | 100° C. 30 min | 0.31 | 1.70 | 5.48 |
| Example 17 | Tetrahydrofuran | 66 | 15 | 100° C. 30 min | 0.30 | 1.65 | 5.50 |
| Example 18 | Tetrahydrofuran | 66 | 26.3 | 100° C. 30 min | 0.60 | 0.60 | 1.00 |
| Example 19 | Tetrahydrofuran | 66 | 22.5 | 110° C. 30 min | 0.16 | 2.40 | 15.00 |
| Example 20 | Tetrahydrofuran | 66 | 15 | 100° C. 30 min | 0.30 | 1.75 | 5.83 |
| Example 21 | Tetrahydrofuran | 66 | 15 | 100° C. 30 min | 0.29 | 1.70 | 5.86 |
| Comparative Example 1 | — | | 0 | 110° C. 30 min | 0.01 | — | — |
| Comparative Example 2 | — | | 0 | 100° C. 30 min | 0.01 | 0.30 | 30.00 |
| Comparative Example 3 | Tetrahydrofuran | 66 | 15 | 100° C. 30 min | 0.30 | 1.71 | 5.70 |
| Comparative Example 4 | Dimethoxymethane | 42 | 7.5 | 100° C. 30 min | 0.30 | 1.71 | 5.70 |
| Comparative Example 5 | Dimethoxymethane | 42 | 7.5 | 100° C. 30 min | 0.32 | 1.71 | 5.34 |
| Comparative Example 6 | Tetrahydrofuran | 66 | 15 | 100° C. 30 min | 0.32 | 1.71 | 5.34 |
| Comparative Example 7 | Tetrahydrofuran | 66 | 18.8 | 80° C. 60 min | 3.05 | 5.12 | 1.68 |

TABLE 2

| | Protective layer | | | | | | |
|---|---|---|---|---|---|---|---|
| | Compound having polymerizable functional group | | | | | | |
| | Type | Part by mass | Type | Part by mass | Film thickness (μm) | Heating temperature in step (A) (° C.) | Heating temperature in step (B) (° C.) |
| Example 1 | (2-1) | 8 | (3-1) | 16 | 1.5 | 100 | 220 |
| Example 2 | (2-2) | 8 | (3-1) | 16 | 1.5 | 120 | 220 |
| Example 3 | (2-3) | 8 | (3-1) | 16 | 1.5 | 120 | 220 |
| Example 4 | (2-1) | 8 | (3-1) | 16 | 1.5 | 100 | 220 |
| Example 5 | (2-1) | 8 | (3-1) | 16 | 1.5 | 100 | 180 |
| Example 6 | (2-1) | 8 | (3-1) | 16 | 1.5 | 100 | 230 |
| Example 7 | (2-1) | 8 | (3-1) | 16 | 1.5 | 100 | 160 |
| Example 8 | (2-4) | 8 | (3-4) | 16 | 1.5 | 120 | 180 |
| Example 9 | (2-1) | 8 | (3-4) | 16 | 1.5 | 120 | 160 |
| Example 10 | (2-1) | 8 | (3-4) | 16 | 1.5 | 100 | 150 |
| Example 11 | (2-1) | 8 | (3-4) | 16 | 1.5 | 100 | 160 |
| Example 12 | (2-1) | 8 | (3-4) | 16 | 1.5 | 100 | 160 |
| Example 13 | (2-1) | 8 | (3-4) | 16 | 1.5 | 120 | 180 |
| Example 14 | (2-2) | 8 | (3-5) | 16 | 1.5 | 100 | 160 |
| Example 15 | (2-2) | 8 | (3-5) | 16 | 1.5 | 120 | 160 |
| Example 16 | (2-1) | 8 | (3-1) | 16 | 1.0 | 100 | 160 |
| Example 17 | (2-1) | 8 | (3-1) | 16 | 1.5 | 100 | 160 |

TABLE 2-continued

| | Protective layer | | | | | | |
|---|---|---|---|---|---|---|---|
| | Compound having polymerizable functional group | | | | | | |
| | Type | Part by mass | Type | Part by mass | Film thickness (μm) | Heating temperature in step (A) (° C.) | Heating temperature in step (B) (° C.) |
| Example 18 | (2-1) | 8 | (3-1) | 16 | 1.5 | 100 | 160 |
| Example 19 | (2-1) | 8 | (3-1) | 16 | 1.5 | 100 | 160 |
| Example 20 | (2-4) | 12 | (3-7) | 12 | 1.5 | 100 | 160 |
| Example 21 | (2-6) | 8 | (3-1) | 16 | 1.5 | 100 | 160 |
| Comparative Example 1 | (2-1) | 8 | (3-1) | 16 | 1.5 | 100 | 160 |
| Comparative Example 2 | (2-3) | 8 | (3-1) | 16 | 1.5 | 120 | 160 |
| Comparative Example 3 | (2-2) | 8 | (3-5) | 16 | 5 | 100 | 160 |
| Comparative Example 4 | (2-1) | 8 | (3-1) | 16 | 1.5 | — | 160 |
| Comparative Example 5 | (2-1) | 8 | (3-1) | 16 | 1.5 | 200 | 200 |
| Comparative Example 6 | (2-1) | 8 | (3-1) | 16 | 1.5 | 230 | — |
| Comparative Example 7 | (2-1) | 8 | (3-1) | 16 | 1.5 | 120 | 220 |

TABLE 3

| | Results | | | |
|---|---|---|---|---|
| | Magnified observation of wrinkle shape | Torque relative value | Average pitch between wrinkles (μm) | Variation in average pitch between wrinkles (μm) |
| Example 1 | Observable | 0.72 | 19 | 2 |
| Example 2 | Observable | 0.73 | 18 | 2 |
| Example 3 | Observable | 0.71 | 18 | 2 |
| Example 4 | Observable | 0.71 | 19 | 2 |
| Example 5 | Observable | 0.68 | 15 | 1 |
| Example 6 | Observable | 0.67 | 15 | 2 |
| Example 7 | Observable | 0.68 | 15 | 1 |
| Example 8 | Observable | 0.67 | 15 | 1 |
| Example 9 | Observable | 0.66 | 12 | 1 |
| Example 10 | Observable | 0.67 | 12 | 1 |
| Example 11 | Observable | 0.68 | 12 | 1 |
| Example 12 | Observable | 0.66 | 12 | 1 |
| Example 13 | Observable | 0.66 | 13 | 2 |
| Example 14 | Observable | 0.68 | 12 | 1 |
| Example 15 | Observable | 0.68 | 12 | 1 |
| Example 16 | Observable | 0.65 | 8 | 1 |
| Example 17 | Observable | 0.68 | 12 | 1 |
| Example 18 | Observable | 0.68 | 13 | 1 |
| Example 19 | Observable | 0.67 | 12 | 1 |
| Example 20 | Observable | 0.67 | 12 | 1 |
| Example 21 | Observable | 0.67 | 12 | 1 |
| Comparative Example 1 | Unobservable | 1.01 | — | — |
| Comparative Example 2 | Unobservable | 1.00 | — | — |
| Comparative Example 3 | Observable | 0.85 | 85 | 8 |
| Comparative Example 4 | Unobservable | 0.99 | — | — |
| Comparative Example 5 | Observable | 0.72 | 29 | 7 |
| Comparative Example 6 | Observable | 0.73 | 35 | 6 |
| Comparative Example 7 | Observable | 0.75 | 25 | 5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-075637, filed Apr. 21, 2020, which is hereby incorporated by reference herein in its entirety.

What is claimed is:

1. A method for producing an electrophotographic photosensitive member comprising, in this order, a support, a charge generation layer, a charge transport layer, and a protective layer having an outer surface with wrinkles, the method comprising the steps of:

forming the charge generation layer on the support;

forming the charge transport layer on the charge generation layer by forming a coating film for the charge transport layer using a coating solution comprising a first solvent, a second solvent having a boiling point higher than a boiling point of the first solvent, a charge transport substance and a resin, and then heating the coating film for the charge transport layer to form the charge transport layer, wherein an amount of residual first solvent in the charge transport layer is 0.05 to 2.50% by mass based on a total mass of the charge transport layer, and an amount of residual second solvent in the charge transport layer is 0.50 to 2.50% by mass based on a total mass of the charge transport layer, and forming the protective layer on the charge transport layer, wherein the protective layer is formed by (A) forming a coating film for the protective layer using a coating solution comprising a compound having a chain polymerizable functional group, and irradiating, under a nitrogen atmosphere having an oxygen concentration of 10 ppm or less, the coating film to be cured for the protective layer with radiation, followed by heating, under a nitrogen atmosphere having an oxygen concentration of 10 ppm or less, the coating film to be cured at a temperature lower than the boiling point of the first solvent to form a cured film with a film thickness of 1.5 μm or less, and (B) further heating, in the air, the cured film at a temperature higher than the boiling point of the first solvent to form the protective layer having the wrinkled outer surface.

2. The method for producing an electrophotographic photosensitive member according to claim 1, wherein a ratio of the amount of residual second solvent to the amount of residual first solvent in the photosensitive layer is 1.00 to 15.00.

3. The method for producing an electrophotographic photosensitive member according to claim 1, wherein the heating temperature in step (B) is lower than the boiling point of the second solvent.

4. The method for producing an electrophotographic photosensitive member according to claim 1, wherein the boiling point of the first solvent is 90 to 150° C., and the boiling point of the second solvent is 153 to 230° C.

5. The method for producing an electrophotographic photosensitive member according to claim 3, wherein the boiling point of the first solvent is 90 to 150° C., and the boiling point of the second solvent is 153 to 230° C.

6. The method for producing an electrophotographic photosensitive member according to claim 4, wherein a difference between the boiling points of the second and first solvents is 40 to 100° C.

7. The method for producing an electrophotographic photosensitive member according to claim 5, wherein a difference between the boiling points of the second and first solvents is 40 to 100° C.

8. The method for producing an electrophotographic photosensitive member according to claim 1, wherein the radiation is electron beam.

* * * * *